US007912686B2

(12) United States Patent
Noetinger et al.

(10) Patent No.: US 7,912,686 B2
(45) Date of Patent: Mar. 22, 2011

(54) METHOD OF OPTIMIZING ENHANCED RECOVERY OF A FLUID IN PLACE IN A POROUS MEDIUM BY FRONT TRACKING

(75) Inventors: Benoît Noetinger, Paris (FR); Pavel Spesivtsev, Rueil-Malmaison (FR)

(73) Assignee: IFP, Cedex (FR)

( * ) Notice: Subject to any disclaimer, the term of this patent is extended or adjusted under 35 U.S.C. 154(b) by 760 days.

(21) Appl. No.: 11/838,919

(22) Filed: Aug. 15, 2007

(65) Prior Publication Data

US 2008/0046223 A1 Feb. 21, 2008

(30) Foreign Application Priority Data

Aug. 16, 2006 (FR) ..... 06 07374

(51) Int. Cl.
*G06G 7/50* (2006.01)

(52) U.S. Cl. ..... 703/9

(58) Field of Classification Search ..... 703/9
See application file for complete search history.

(56) References Cited

OTHER PUBLICATIONS

James Glimm et al., "Front tracking for petroleum reservoir simulation", 1983, Society of Petroleum engineers, SPE 12238, pp. 41-49.*
H. Fyrozjaee et al., "Control of a displacement front in potential flow using flow-rate partition", Apr. 2006, Society of Petroleum Engineers, SPE 99524, pp. 1-7.*
Vedat Batu, "Applied Flow and solute transport modeling in aquifers: fundamental principles and analytical and numerical methods", 2006, chapter 6, "Stochastic analysis of flow and solute transport in heterogeneous aquifers and determination of expressions for dispersivities using stochastic approaches", Taylor & Francis, pp. 415-580.*
R. Juanes et al., "A front-tracking method for efficient simulation of miscible gas injection", 2005, Society of Petroleum Engineers, SPE 93298, pp. 1-18.*
E.V. Teodorovich, "An improved perturbation theory method for describing the effective permeability of a randomly heterogeneous medium", 2002, Journal of Applied Mathematics and Mechanics, vol. 66, No. 3, pp. 439-446.*
Dongxiao Zhang et al., "Stochastic analysis of immiscible two-phase flow in heterogeneous media", 1999, Society of Petroleum Engineers, SPE 59250, pp. 380-388.*
John R. Fanchi, "Principles of applied reservoir simulation", 2001, second edition, Elsevier Science Publishers, pp. 1-355.*

(Continued)

*Primary Examiner* — Paul L Rodriguez
*Assistant Examiner* — Russ Guill
(74) *Attorney, Agent, or Firm* — Antonelli, Terry, Stout & Kraus, LLP.

(57) ABSTRACT

The method of the invention optimizes the development of a heterogeneous porous medium using enhanced recovery of a fluid by fast determination of position of a front separating a sweeping fluid and the fluid in the medium having application for development of oil reservoirs or gas. The velocity field of the front is determined only once with a flow simulator. A relation describing the position of the front in the heterogeneous medium is defined. Velocity fluctuations are accounted for in the direction of the front and the velocity fluctuations in the direction perpendicular to the direction of the front. For each time interval, the position of the front is reconstructed with a fast Fourier transform and injection of the sweeping fluid is optimized according to the position of the front.

16 Claims, 1 Drawing Sheet

OTHER PUBLICATIONS

Jamal H. Abou-Kassem et al, "Petroleum Reservoir Simulation", chapter 10, "Introduction to modeling multiphase flow in petroleum reservoirs", 2006, Gulf Publishing Company, pp. 365-420.*

Noetinger B., et al: "Stochastic Anaylsts of a Displacement Front in a Rrandomly Heterogeneous Medium" Fluid Dynamics, vol. 41, No. 5, 2006, pp. 830-842, XP008076094.

Noetinger B., et al: "Dynamics of the Water-Oil Front For Two-Phase, Immiscible Flow in Heterogeneous Porous Media, I-Stratified Media", Transport in Porous Media, 2004, xp002423633.

Spesivtsev, P., et al: "The Velocity Variance Tensor in a Plane Seepage Flow", Fluid Dynamics, vol. 39, No. 3, May 2004, XP008076098.

* cited by examiner

METHOD OF OPTIMIZING ENHANCED RECOVERY OF A FLUID IN PLACE IN A POROUS MEDIUM BY FRONT TRACKING

BACKGROUND OF THE INVENTION

1. Field of the Invention

The present invention relates to a method for optimizing the development of a heterogeneous porous medium by enhanced recovery of a fluid in place, by determining the position of the front separating a sweeping fluid and the fluid in place.

2. Description of the Prior Art

All the notations used to describe the prior art and the invention are defined at the end of the description.

Describing and simulating multiphase flows in underground reservoirs is fundamental to a reservoir engineers' skill in working with petroleum or gas companies (or, similarly, in water adduction companies). The presence of subsoil heterogeneities and the increasing complexity of drainage systems make a simple analytical solution impossible, which requires development of numerical solutions using a gridded model. The simulation of multiphase flows in a heterogeneous porous medium can then require considerable computing resources, in particular when the numerical model of the medium considered is greatly detailed. This is the case for reservoir engineering in the petroleum field. The cost is mainly due to the computer-based solution of large-size linear systems from the equation that governs the pressure, which has to be updated by following the fluid displacement in order to reach a solution of good precision.

In a two-phase flow in a heterogeneous porous medium, the displacement of a fluid in place (oil for example) is considered under the effect of the injection of another fluid (water for example). The generalized Darcy's law that governs the motion of fluids is written as follows, by means of standard hypotheses and notations:

$$u_{nw} = -\lambda_{nw}\nabla p_{nw}, \quad \lambda_{nw} = \frac{Kk_{rnw}}{\mu_{nw}} \tag{1}$$

$$u_w = -\lambda_w\nabla p_w, \quad \lambda_{rw} = \frac{Kk_{rw}}{\mu_w} \tag{2}$$

$$u=u_{nw}+u_w \tag{3}$$

where subscripts nw and w designate the nonwetting and wetting fluids respectively. The pressure difference between the two fluids is denoted by $p_c(S)=p_{nw}-p_w$. The relation is as follows:

$$S_{nw}+S_w=1 \tag{4}$$

It is therefore possible to write all the functions depending on saturation S in terms of saturation $S_W$.

By disregarding the capillary pressure, the relationship is:

$$p_{nw}=p_w=p \tag{5}$$

The total velocity then is written as follows:

$$u=-\lambda(S_w)\nabla p \tag{6}$$

with:

$$\nabla.u=0 \tag{7}$$

This system of equations (6) and (7) defines the pressure equation.

In equations (1) and (2), functions $k_r$ are the relative permeabilities. The function: $k_r=k_r(S_w)$. Functions $\lambda_{nw}$ are the respective mobilities of the fluids, and $\lambda(S_w)=\lambda_{nw}(S_w)+\lambda_w(S_w)$ defines the total mobility, which thus explicitly depends on $S_W$.

The mass conservation laws relative to each fluid are written as follows:

$$\phi\frac{\partial S_{nw}}{\partial t} + \nabla\cdot u_{nw} = 0 \tag{8}$$

$$\phi\frac{\partial S_w}{\partial t} + \nabla\cdot u_w = 0 \tag{9}$$

The system of equations (8) and (9) defines the saturation equation. The term, $\phi$ is the porosity (assumed to be uniform in the reservoir), t the time and $u_{n,nw}$ is the velocity of the fluid considered.

One of the difficulties in solving these equations comes from the coupling between equations (6) to (9) that couple the saturation to the pressure field. These effects are well known and they control the development of possible viscous instabilities. In particular, in the 1D case, considering sweeping of an initially oil-saturated medium with water, this system of equations can be solved by the method of characteristics, whose solutions are governed by the existence of oscillations corresponding to saturation jumps propagating in the medium.

The discontinuity is governed by a water saturation changing from $S_{wi}$ to $S_f$, the saturation at the front whose value is given by a Rankine-Hugoniot type condition. In the petroleum context, construction of the Welge tangent allows graphical determination of $S_f$. Behind this front, a "rarefaction wave" provides, upon injection, transition between $S_f$ and the water saturation upon injection.

There are several known techniques for determining the simulation of multiphase flows in heterogeneous porous media. These methods are all based on the solution of the following system of equations:

$$\begin{cases} \text{Pressure equation:} \\ u = -\lambda(S_w)\nabla p & (10) \\ \nabla\cdot u = 0 & (11) \\ \text{Saturation equation:} \end{cases}$$

$$\phi\frac{\partial S_{nw}}{\partial t} + \nabla\cdot u_{nw} = 0 \tag{12}$$

$$\phi\frac{\partial S_w}{\partial t} + \nabla\cdot u_w = 0 \tag{13}$$

The techniques differ in the method used for solving this system. Generally, in a complex heterogeneous medium, this type of system of equations has to be solved numerically.

Oil companies most often use conventional discretization techniques of finite volume type (Aziz, Kb., Settary, A.: Petroleum Reservoir Simulation. Applied Science Publishers, London, 1979). Concerning temporal discretization, there are many choices: if numerical robustness is favored, pressure as well as saturation can be totally implied. If oscillations of the solution are preferably avoided and higher accuracy is desired, an implicit scheme will be selected for pressure, and explicit for saturation. The existence of fronts is generally observed which are governed by the same discontinuity of the saturation, whose value suddenly changes from the irreducible water saturation, $S_{wi}$, to the front saturation $S_f$. These discontinuities are due to the hyperbolic character of the saturation transport equation and are described analytically in the case of the 1D displacement: it is the Buckley-Leverett theory that is described in detail in Charles-Michel Marie's work *Les Écoulements Polyphasiques en Milieu Poreux*. Seconde Édition Revue et Augmentéé 1972. Editions Technip, Paris.

Whatever the method which is selected, the pressure equation has to be regularly updated to precisely estimate the velocities.

Another class of techniques, which are more and more commonly used by operator companies, comprises the techniques referred to as "streamline," with one reference being: R. P. Batycky, M. J. Blunt, and M. R. Thiele, A 3d Field-Scale Streamline-Based Reservoir Simulator, SPERE, 11, 246-254 (1997).

In these methods, the saturations are updated by following the displacement of the fluids in their motion along the streamlines, parametrized curves defined by dx/dt=u(x,t). A variable change allows returning to the aforementioned Buckley-Levereft theory. However, in order to properly calculate velocity u(x,t), the pressure is solved as many times as required for accuracy reasons, on a Cartesian grid. These methods are faster than conventional methods. They do not have the versatility and the robustness for dealing with complex compositional problems where the conventional method remains the only possible solution. Costly pressure field updating cannot be avoided.

Finally, there are front tracking techniques (R Juanes a,d K A Lie "A Front Tracking Method for Efficient Simulation of Miscible Gas Injection." paper SPE 92298, Houston 31 Jan. to 2 Feb. 2005) are known which monitor the front by a Lagrangian approach requiring the same pressure updating. In this type of method, the description of multiphase flows in underground reservoirs determines the position of the front (also referred to as interface) separating two immiscible fluids in motion which are a fluid in place (oil for example) and a sweeping fluid (water for example), also called injected fluid.

The evolution of the front in the reservoir as it flows therethrough is considerably influenced by coupling (referred to as viscous coupling by reservoir engineers) between the pressure field and the saturation field (Saffman P. G. and G. Taylor. The penetration of a fluid into a porous medium or hele-shaw cell containing a more viscous liquid. *Proc. Royal Society of London*, A245:312-329, 1958, Nœtinger B., V. Artus, and L. Ricard, Dynamics of the Water-Oil Front for Two-Phase, Immiscible Flows in Heterogeneous Porous Media. 2-Isotropic Media. *Transport in porous media,* 56:305-328, 2004).

In particular, when the injected fluid is less viscous and consequently more mobile at the front than the fluid in place, the viscous instabilities will always favour flow of the fluids in the most permeable layers of the medium. The breakthrough time through these layers is much faster than in the rest of the reservoir. On the other hand, if the injected fluid is less mobile, the viscous coupling can slow the injected fluid down in the initially higher-velocity layers, thus compensating for the permeability differences due to the stratification. A stationary front then appears (Artus V., B. Nœtinger, and L. Ricard, Dynamics of the Water-Oil Front for Two-Phase, Immiscible Flows in Heterogeneous Porous Media. 1-Stratified Media, *Transport in Porous Media,* 56:283-303, 2004).

It is well known that the front stability after small perturbations is determined by the fluid viscosity ratio. If the less viscous fluid is displaced by the more viscous fluid, then the front is stable, and vice versa. If the situation is unstable, phenomena referred to as "viscous fingers" develop in the course of time.

The effects of the relative permeability are taken into account by considering the Buckley-Leverett type displacements in a homogeneous medium. Such displacements are described by a hyperbolic saturation equation. One solution to this equation using the method of characteristics provides solutions that have oscillations characterized by a Rankine-Hugoniot condition. It has been shown that the stability of the front where the saturation has a "shock" is determined by a frontal mobility ratio, denoted by $M_f$;if $M_f<1$ for which the front is stable in the face of small perturbations, and vice versa. This frontal mobility ratio can be related to the viscosity ratio using the relative permeability function.

More recently, this result was confirmed within the context of linearized stability analyses of the water injection process. In this context, it has been shown that the evolution of the Fourier transform of the front position fluctuations, the latter being denoted by □h(q, t), in a homogeneous medium is given by:

$$\partial_t \delta h(q, t) = c_0 |q| \frac{M_f - 1}{M_f + 1} \delta h(q, t) \tag{14}$$

where:

$$c_0 = \frac{u_0}{\phi} \frac{f_w(S_f) - f_w(S_{wr})}{S_f - S_{wr}} = \frac{u_0}{\phi} f_w'(S_f)$$

with:

$M_f$ is the frontal mobility ratio;

$u_0$ is the mean filtration rate along the direction of axis X;

$\phi$ is the porosity;

$f_w$ is the Buckley-Leverett function representing the fractional water flow;

$S_f$ is water saturation at the front; and $S_{wr}$ is maximum water saturation.

In summary, all the aforementioned numerical techniques are costly in computing time, mainly because of the large number of solutions of large-sized linear systems from the equation governing pressure, that have to be updated by monitoring the displacement of the fluids with good precision.

Existing solutions do therefore not allow obtaining quantitative answers to practical questions that petroleum engineers consider when carrying out reservoir simulation studies, that is:

1. Fast sampling of the space of the study parameters that the modelling relates to, is important to optimize one or more economic and technical development criteria (development decision, selection of the position of the wells, of a recovery method, etc.).

2. Knowledge of how to coherently modify the geologic model is important in order to best calibrate the observed production data, including repeated seismic survey data. This can allow drilling while adapting to the geologic heterogeneities, to locate the fluids and therefore to better control the recovery scenario.

3. The ability to estimate uncertainties by carrying out Monte Carlo simulations is important to test the role of heterogeneities or of little-known parameters characterizing the subsoil. This allows quantification of the risk level linked with the development of a reservoir and thus to redefine development parameters, or even the economic parameters.

An exhaustive study including these various aspects (sensitivity study, data calibration and uncertainty estimation) can then potentially require repeated use of a flow simulator (dedicated software), hence the advantage of fast computing tools, of a precision compatible with that of the input data.

The method according to the invention allows determination of the position of a front separating two immiscible fluids in motion in a heterogeneous porous medium, without systematically updating the pressure field so as to obtain a simulation of the multiphase flows in the porous medium that is fast enough to obtain quantitative information allowing optimum development of the reservoir, by determining technical development parameters and/or economic parameters.

SUMMARY OF THE INVENTION

The invention relates to a method of optimizing the development of a heterogeneous porous medium containing a fluid, referred to as fluid in place.

In particular, the method according to the invention allows determination of the position of a front separating two immiscible fluids in motion, without systematically updating the pressure field, so as to obtain a simulation of the multiphase flows in the porous medium that is fast and accurate enough to allow obtaining quantitative information for optimum development of the medium. The method has, for example, applications notably for the development of oil or gas reservoirs, or the development of underground gas storage.

Development is achieved by injecting into the medium a second fluid, referred to as sweeping fluid, to cause flow of the fluid in place. These two fluids are immiscible. According to the method, the medium is discretized into a grid consisting of a set of cells. The method comprises the following stages:

determining a velocity and a direction of flow for at least one of the fluids, using a flow simulator to solve a pressure equation;

defining a relation describing a position of a front separating the fluids, without viscous coupling using perturbation theory, and by accounting for the velocity fluctuations in the direction of frontal advance and the velocity fluctuations in the direction perpendicular to the direction of frontal advance; and for different time intervals;

reconstructing the position of the front in the grid by a discretization of the relation and of a fast Fourier transform; and optimizing the injection of the sweeping fluid according to the position of the front.

According to the method, the relation can notably comprise:

a first term representing a viscous coupling describing the perturbation due to the saturation variation; and a second term describing the perturbations of the position of the front caused by the medium heterogeneities.

This first term can be obtained by considering the homogeneous medium and the front displacements of the Buckley-Leverett type. The second term can be obtained considering the front as a material surface and by representing the velocity as a sum of a mean velocity with velocity fluctuations due to the heterogeneities.

The first term can depend on at least the following parameters: a frontal mobility ratio, a mean filtration rate along a front advance direction, a porosity of the medium, a Buckley-Leverett function representing a fractional water flow, a water saturation at the front, a maximum water saturation and the wave vector in the Fourier space.

The second term can depend on at least the following parameters: a nonperturbed front velocity, a mean total velocity and perturbations of the components of the total velocity in the direction of frontal advance direction and in the direction perpendicular thereto.

Finally, to optimize the injection, it is possible to determine at each cell and for different time intervals the saturation of at least one of the fluids from the position of the front.

BRIEF DESCRIPTION OF THE DRAWINGS

Other features and advantages of the method according to the invention will be clear from reading the description hereafter of non limitative embodiment examples, with reference to the accompanying figures wherein.

DETAILED DESCRIPTION

Figure 1A:
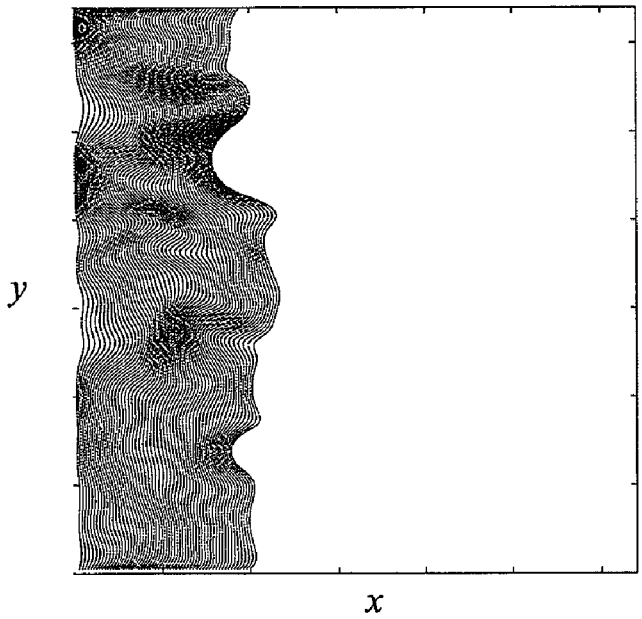
FIGS. 1A and 1B show a comparison between the result provided by the method according to the invention (FIG. 1A) and a streamline-based simulation (FIG. 1B).

The method according to the invention allows optimizing the development of a heterogeneous porous medium using enhanced oil recovery (EOR) for example. This technique injects, into a petroleum reservoir, a sweeping fluid ($CO_2$, water) so as to cause flow of a fluid in place (oil), contained in the reservoir, that is to be extracted. These two fluids must of course be immiscible.

For enhanced recovery, a situation is encountered where there is an interface, referred to as front, separating the two fluids. On the reservoir scale, the width of this front is small in relation to the size of the petroleum reservoir under study and, for simplicity reasons, this front is assumed to be narrow in relation to the size of the reservoir. The study is focused on the dynamics of the front in a heterogeneous porous medium with the capillary effects and gravity being disregarded.

The method according to the invention allows optimizing the injection by determining, for different times, referred to as "time intervals," the position of the front separating the two fluids in motion in a heterogeneous porous medium (the reservoir for example). The method is based on an original technique of systematically updating the pressure field, which affords the advantage of being both precise and fast, insofar as the method requires only very limited use of a simulator carrying out long and complex calculations. Updating of the pressure field, due to the change in the front geometry, is therefore performed semi-analytically by use of a fast Fourier transform techniques (FFT). Most of the calculation time due to updating the pressure field updating is thus saved, hence the speed of the method. The method comprises:

discretizing the medium into a set of grid cells;

determining the velocity field for each one of the fluids;

defining a relation describing the position of the front in a heterogeneous medium
for time intervals;

estimating a position of the front by use of the relation and of the velocities; and optimizing injection of a sweeping fluid according to the position of front.

Discretization of the Medium

Discretization of the medium is conventional. It allows representation of the structure of the medium in a set of cells characterized by their dimensions and their geographic positions. Calculations are carried out for each cell. Discretization is essential for using flow simulators (the simulator is a dedicated software). This set of cells is referred to as a "grid". The grid discretizing the medium can be rectangular of size $L_x \times L_y$ cells.

Determination of a Heterogeneous Velocity Field

A heterogeneous velocity field is determined within a single-phase flow. The pressure equation (equations (6) and (7)) obtained by combining Darcy's law and the incompressibility equation is numerically solved by a single-phase flow simulator. The velocity vector of each fluid, that is the velocity and the direction of flow thereof, is thus determined at a time t=0.

For a 2D domain (the 3D case is dealt with in exactly the same way) of size $L_x \times L_y$ whose permeability map is K(x, y) and for which the main flow is parallel to an axis X, y representing the transverse co-ordinate (on axis Y), solution of the pressure equation solves the equation as follows:

$$\nabla.(\lambda(S_w(x,y,t=0).\nabla P(x,y))=0$$

Thus from these equations, the total velocity field u: $u_{nw}$, the velocity vector of the nonwetting fluid, and $u_w$, the velocity vector of the wetting fluid is deduced.

The solution, which requires a simulator, is carried out only once according to the method of the invention. The pressure equation is solved in the beginning, that is for t=0, and is no longer solved in the subsequent time intervals (t>0).

A standard five-point finite-volume type discretization can be used to solve this equation with the simulator. The pressure is estimated at the center of the cells. The flows between cells involve calculated transmissivities determined by the harmonic means of the permeabilities of the two cells. Darcy's law then allows determination of the flows and the velocities.

The permeability map K(x, y) can be generated by use of a random field generator, as described in the following document for example:

Le Ravalec, M., Nœtinger, B., and Hu, L. Y. [2000] The FFT Moving Average (FFT-MA) Generator: An Efficient Numerical Method for Generating and Conditioning Gaussian Simulations, Mathematical Geology 32(6), 701-723.

Definition of a Relation Describing the Position of the Front in a Heterogeneous Medium Recalculating at each time iteration the flow in the entire calculation domain is avoided, by limitation to the description of the motion of the front, described by a function □h(y, t). This is possible by using an approximation allowing relating modification of the pressure field □p(x, y, t), and therefore of the velocities, to the distortion of the front □h(y, t). The pressure can thus be eliminated from the problem and then a differential system involving □h(y, t) must be solved.

As seen above, in a homogeneous medium, the evolution of the Fourier transform of the front position fluctuations, denoted by □h(q, t), is given by:

$$\partial_t \delta h(q, t) = c_0|q|\frac{M_f - 1}{M_f + 1}\delta h(q, t) \tag{14}$$

where:

$$c_0 = \frac{u_0}{\phi}\frac{f_w(S_f) - f_w(S_{wr})}{S_f - S_{wr}} = \frac{u_0}{\phi}f_w'(S_f)$$

with:

$M_f$ is the frontal mobility ratio $u_0$ is the mean filtration rate in the direction of axis x $\phi$ is the porosity $f_w$ is the Buckley-Leverett function representing the fractional water flow $S_f$ is water saturation at the front $S_{wr}$ is maximum water saturation q is wave vector in the Fourier space In a heterogeneous medium, the problem is more complex. The permeability field heterogeneities initiate perturbations of the front, that is the front is deformed according to the strata permeability. Thus, these perturbations can increase or decrease according to the viscosity ratio. This is the problem of viscous coupling. The problem is nonlinear and a mathematical analysis is very complicated.

According to the invention, the heterogeneities are taken into account, on the one hand, without consideration of a viscous coupling utilizing a perturbation theory and, by accounting for the transverse velocity fluctuations, that is velocity fluctuations along an axis Y perpendicular to a frontal advance axis X.

Decoupling Using the Perturbation Technique

The method according to the invention estimates the coupling between the velocity perturbations □u and the fluctuation of the front position □h in a semi-analytical way. In this sense, the method uses the perturbation theory.

From a heuristic point of view, the perturbation theory is a general mathematical method that allows finding an approximate solution to a mathematical equation ($E_\lambda$) depending on a parameter $\lambda$ when the solution to equation ($E_0$), corresponding to value $\lambda$=0, is exactly known. Mathematical equation ($E_\lambda$) can be an algebraic equation, a differential equation, an eigenvalue equation, etc. The method seeks the approximate solution to equation ($E_\lambda$) in a form of a series expansion of the powers of parameter $\lambda$. The approximate solution is assumed to be an approximation of the exact but unknown solution that improves as the absolute value of parameter $\lambda$ is "smaller".

Thus, according to the invention, the perturbation theory provides local consideration of the velocity perturbation as the sum of two perturbations:

$$\delta u(x,y,t)=\delta u_a(x,y,t)+\delta u_b(x,y,t) \tag{15}$$

The first term, $\delta u_a$, describes the perturbation due to the saturation variation, and the second term, $\delta u_b$, describes the perturbation due to the heterogeneity of the medium.

According to this expansion, the position of the front as it progresses in a heterogeneous porous medium by the equation can be described as follows:

$$\partial_t \delta h(q, t) = c_0 A|q|\delta h(q, t) + \frac{c_0}{u_0}\delta u_{bx}(x_f, q, t) \tag{16}$$

with:

$$A = \frac{M_f - 1}{M_f + 1}$$

$\delta u_{bx}$ is the fluctuations of the filtration rate in the front advance direction (axis X)

$x_f$ is the abscissa of the front position on axis X.

Thus, by this formulation of the front position, it is possible to decouple the problem. For small-variance permeability fields, the stability of the front undergoing small perturbations is therefore determined by the frontal mobility ratio.

Accounting for the Transverse Velocity Fluctuations

According to the invention, the front propagation in a heterogeneous medium, that is in a heterogeneous velocity field, is simulated by analytically modelling the influence of the viscous effects. The heterogeneous velocity field was obtained using a single-phase flow simulation (stage 2 of the method).

To simplify the explanations, two dimensions are taken. The front separating the two immiscible fluids is then described by a 2D function, x(y, t)=h(y, t). This equation can then be written in the form as follows:

$$F(x,y,t)=0 \tag{17}$$

By solving equation (17) in relation to x, it is obtained:

$$F_1(x,y,t)=h(y,t)-x=0 \tag{18}$$

Then, using the fact that the surface in question is material, that is made up of fluid elements that follow the local motion of the fluid, and using the expression for the front propagation velocity for Buckley-Leverett type displacements, it is obtained:

$$\partial_t h(y,t)=c_0(u\cdot\nabla\phi)|_{\phi=0} \tag{19}$$

Considering now the heterogeneity of the velocity field, the velocity is represented as a sum of two terms. The first one represents the mean and the second the fluctuations due to the heterogeneities:

$$u(r)=u_0+\delta u(r)$$

with: $r=\{x, y\}$, $u_0=\{u_0, 0\}$ and $\delta u=\{\delta u_x, \delta u_y\}$.

The velocity field perturbations cause front perturbations $h(y,t)=h_0(t)+\delta h(y,t)$. By substituting this expansion in equation (19) and by extracting the mean term using relation $\partial_t h_0(t)=c_0$, which is valid for Buckley-Leverett type displacements, the following equation is obtained describing the front position perturbations caused by the medium heterogeneities:

$$\partial_t \delta h(y,t) = \frac{c_0}{u_0}(\delta u_x(x_f, y) - \delta u_y(x_f, y)\partial_y \delta h(y,t)) \tag{20}$$

Thus, by applying the perturbation theory, the material surface theory, and using the expression of the front propagation velocity for Buckley-Leverett type displacements, the position of the front in a heterogeneous porous medium can be described as follows (δh was substituted for h in this expression for clarity reasons):

$$\partial_t h(y,t) = c_0 A \int \frac{dq}{2\pi}|q|h(q,t)e^{iqy} + \frac{c_0}{u_0}(\delta u_x(x_f, y) - \delta u_y(x_f, y)\partial_y h(y,t)) \tag{21}$$

The first term (left) is the expression of the viscous coupling and it can be advantageously calculated in the Fourier space. It is therefore no longer necessary to estimate this coupling through a costly linear system solution. In the description hereafter, the velocity perturbations □$u_x$ and □$u_y$ can now be assumed to be decoupled from the saturation equation. The second term (right) is obtained by use of a single-phase flow simulator (stage 2 of the invention).

The next stage of the method of the invention provides a complete frontal equation solution technique.

Frontal Position Estimation

A heterogeneous velocity field in the context of a single-phase flow was established in stage 2 of the method according to the invention by numerical solution (by means of a single-phase flow simulator) of the pressure equation.

Then, equation (21) is discretized on the grid discretizing the medium. This discretized equation is then used to obtain the front perturbations for each time interval. An explicit numerical scheme described hereafter is then used.

Subscript i is introduced to number the cells in the direction of axis X, subscript j to number the cells along axis Y, and n to number the time intervals. Δx designates the size of a cell in direction X, Δy the size of a cell in direction Y, and Δt the time interval.

The method of solving discretized equation (21) is as follows:

1. A fast Fourier transform is first performed for the frontal perturbations. In fact, the approximation by a perturbation series expansion has a simple explicit formulation in the Fourier space. Thus, according to the method, the calculation is carried out in the domain where it is the simplest since the cost of a fast Fourier transform (FFT) is considered to be negligible. A fast Fourier transform (FFT) algorithm at y allows the first member of equation (21) to be rapidly estimated:

$$\delta h_k^n = \sum_{j=1}^{N_y} \delta h_j^n \exp\left(-\frac{2\pi i(k-1)(n-1)}{N_y}\right) \tag{22}$$

2. Then the Fourier modes of the front position fluctuations are multiplied by a modulus of the wave vector in the Fourier space, and an inverse Fourier transform is used to return to the real space. The central difference, which is well known, is used to obtain an approximation of the velocity derivative along y. The following explicit scheme is obtained:

$$\begin{aligned}\delta h_j^{n+1} &= \delta h_j^n + c_0 A\Delta t \frac{1}{N_y}\sum_{k=1}^{N_y}\frac{2\pi(k-1)}{N_y\Delta y}\delta h_k^n \exp\left(\frac{2\pi i(k-1)(n-1)}{N_y}\right) + \\ &\quad \frac{c_0}{u_0}\Delta t\left(\delta u_{i,j}^n - \delta v_{i,j}^n \frac{\delta h_{j+1}^n - \delta h_{j-1}^n}{2\Delta y}\right) \\ \delta h_k^n &= \sum_{j=1}^{N_y}\delta h_j^n \exp\left(-\frac{2\pi i(k-1)(n-1)}{N_y}\right)\end{aligned} \tag{23}$$

where subscript i is defined by the position of the front in the previous time interval n. Here, term $\delta h_{i,k}^n$ represents the Fourier transform of the front at frequency k, δu represents the longitudinal velocity fluctuation along axis X ($\delta u_x$), and δv represents the longitudinal velocity fluctuation along axis Y ($\delta u_y$). The discrete Fourier transform and its inverse can be implemented using a fast Fourier transform (FFT) algorithm to speed up the calculations.

After calculating the frontal fluctuations for a given time interval $N_t$, the position of the front is reconstructed in the medium discretization grid by the following formula:

$$h_j^{N_t}=\Delta t N_t c_0+\delta h_j^{N_t} \tag{24}$$

It can be considered that the approximation of velocity u was made once and for all, since the viscous coupling is modelled via the convolution term (first term of equation (21)).

The position of the front can thus be determined explicitly for each time interval after determining only once, at the time t=0, the velocities of the fluids by solving the pressure equation by use of a flow simulator.

Figure 1B:
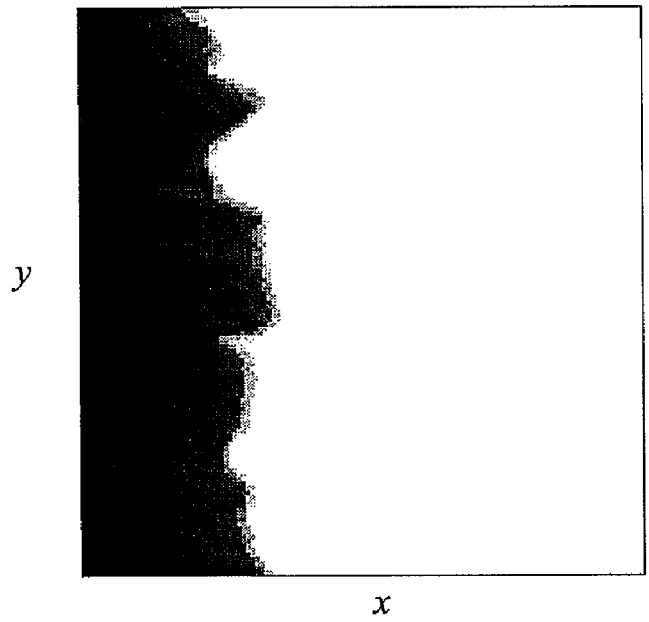

It can be noted that the invention requires only one complete numerical solution of the pressure equation which is unlike techniques that require as many such solutions as there are time intervals. A comparison between the method according to the invention (FIG. 1A) and a simulation using a market streamline-based simulator (FIG. 1B) illustrates that, despite the approximation made to save calculation time, the resultant accuracy remains comparable to the other methods. FIG. 1A shows the front of the interface simulated with the method of the invention, whereas FIG. 1B shows the front of the interface simulated by a market streamline-based simulator. These figures show a cross-sectional view of the subsoil wherein the abscissa axis corresponds to a horizontal geographic co-ordinate x and the ordinate axis represents depth y.

Optimization of Oil Recovery by Injection

From the position of the front, it is known to determine the saturations at each cell of the medium and for each time interval. It is possible to use, for example, the current tube method which is well known, far from the front, and to interpolate the saturations near to the front, whose position is now well determined.

The time when and the point where the fluid to be injected to facilitate recovery will reach the well can be determined by monitoring the geographic and temporal evolution of the saturations. When water is used to "push" the oil in place in a reservoir, knowing these saturations allows determination of the breakthrough time of the water, which is a key datum in oilfield development.

Through fast determination of the saturations, the following can be obtained:

1-Rapid sampling of the space of the study parameters to which the modelling relates to to optimize one or more economic development criteria (development decision, selection of the position of the wells, of a recovery method, etc.).

2-Coherently modify the geologic model in order to best calibrate the observed production data, including repeated seismic survey data. This can allow drilling while adapting to the geologic heterogeneities, to locate the fluids and therefore to better control the recovery scenario.

3-Extimation of uncertainties by Monte Carlo simulations to test the role of heterogeneities or of little-known parameters characterizing the subsoil. This allows quantification of the risk level linked with the development of a reservoir and thus to redefine development parameters, or even the economic parameters.

An exhaustive study including these various aspects (sensitivity study, data calibration and uncertainty estimation) potentially requires repeated use of a flow simulator (dedicated software). Existing solutions do not allow obtaining quantitative answers to practical questions that petroleum engineers consider when carrying out reservoir simulation studies. The advantage of the method according to the invention is providing a fast computing tool, of a precision compatible with that of the input data.

The following notations are used in the description of the invention:

$u_{nw}$: Nonwetting fluid velocity vector
$u_w$: Wetting fluid velocity vector
u: Total velocity of the fluids
$\square_{nw}$: Nonwetting fluid mobility
$\square_w$: Wetting fluid mobility
$p_{nw}$: Nonwetting fluid pressure
$p_w$: Wetting fluid pressure
K: Absolute permeability tensor of the medium
$k_{nw}$: Relative permeability of the nonwetting fluid
$k_w$: Relative permeability of the wetting fluid
$\square_{nw}$: Nonwetting fluid viscosity
$\square_w$: Wetting fluid viscosity
$p_c(S)$: Capillary pressure
$S_{nw}$: Nonwetting fluid saturation
$S_w$: Wetting fluid saturation
p: Common pressure of the two fluids, if $p_c(S)=0$
$\square$: Porosity (assumed to be uniform in the reservoir)
t: Time
$S_{wi}$: Irreducible water saturation
$S_f$: Water saturation at the front
$M_f$: Total mobility ratio at the front
q: Wave vector in the Fourier space
$c_0$: Velocity of the nonperturbed front
$u_0$: Reference constant velocity
$S_{wr}$: Maximum water saturation
$f_w'$: Derivative of the fractional water flow
$h_0$: Reference front position
h(y, t): Front position
$\square h(y, t)$: Front position fluctuation
n: Normal vector at the front
$u_0$: Mean total velocity
$\square u_{nw}$: Perturbation of the nonwetting fluid velocity vector
$\square u_w$: Perturbation of the wetting fluid velocity vector
$\square u$: Perturbation of the total velocity vector of the fluids
$\square u_x$: Perturbation of component x of the total velocity
$\square u_y$: Perturbation of component y of the total velocity
F: Front equation
$F_1$: Front equation in canonical form
$L_x$, $L_y$: Size in x and y of the domain
$V_n$: Normal velocity at the front
f(S): Fractional water flow
$A_1$: Injection area
Q: Total injected flow rate
V: Volume of the porous medium
x: Longitudinal co-ordinate
y: Transverse co-ordinate
k: Discretized wave vector
$t_D$: Nondimensional time by the mean breakthrough time 19,50

The invention claimed is:

1. A method of optimizing recovery of a fluid in place in a heterogeneous porous medium, by injecting into the medium a sweeping fluid to cause flow of the fluid in place, the fluids being immiscible, wherein the medium is discretized into a grid of a set of cells, the method comprising:

determining a velocity and a direction of flow for at least one of the fluids using a computer-based flow simulator to solve a pressure equation;

defining a relation describing a position of a front separating the fluids, by accounting for velocity fluctuations in a frontal advance direction and velocity fluctuations in a direction perpendicular to the frontal advance direction; and for different time intervals, reconstructing a position of the front in the grid by a discretization of the relation and by a fast Fourier transform; and optimizing the injection of the sweeping fluid according to the position of the front; and wherein the relation comprises a first term representing a viscous coupling describing perturbations due to variation in saturation and a second term describing perturbations of the front caused by heterogeneities of the medium.

2. A method as claimed in claim 1, wherein the first term is obtained by considering a homogeneous medium and Buckley-Leverett displacements of the front.

3. A method as claimed in claim 2, wherein the first term depends on at least the following parameters: a frontal mobility ratio, a mean filtration rate along a front advance direction, a porosity of the medium, a Buckley-Leverett function representing a fractional water flow, a water saturation at the front, a maximum water saturation, and a wave vector in Fourier space.

4. A method as claimed in claim 3, wherein injection is optimized by determining at each cell at different time intervals a saturation of at least one of the fluids from a position of the front.

5. A method as claimed in claim 3, wherein the relation is defined without utilizing a viscous coupling by a perturbation theory.

6. A method as claimed in claim 2, wherein injection is optimized by determining at each cell at different time intervals a saturation of at least one of the fluids from a position of the front.

7. A method as claimed in claim 2, wherein the relation is defined without utilizing a viscous coupling by a perturbation theory.

8. A method as claimed in claim 1, wherein the second term is obtained by considering the front to be a material surface and by representing the velocity as a sum of a mean velocity with velocity fluctuations due to the heterogeneities of the medium.

9. A method as claimed in claim 8, wherein the second term depends on at least the following parameters: a nonperturbed front velocity, a mean total velocity, perturbations of components of a total velocity in a frontal advance direction and in a direction perpendicular thereto.

10. A method as claimed in claim 9, wherein injection is optimized by determining at each cell at different time intervals a saturation of at least one of the fluids from a position of the front.

11. A method as claimed in claim 9, wherein the relation is defined without utilizing a viscous coupling by a perturbation theory.

12. A method as claimed in claim 8, wherein injection is optimized by determining at each cell at different time intervals a saturation of at least one of the fluids from a position of the front.

13. A method as claimed in claim 8, wherein the relation is defined without utilizing a viscous coupling by a perturbation theory.

14. A method as claimed in claim 1, wherein injection is optimized by determining at each cell at different time intervals a saturation of at least one of the fluids from a position of the front.

15. A method as claimed in claim 14, wherein the relation is defined without utilizing a viscous coupling by a perturbation theory.

16. A method as claimed in claim 1, wherein the relation is defined without utilizing a viscous coupling by a perturbation theory.

* * * * *